United States Patent [19]

Callgren et al.

[11] Patent Number: 4,657,567

[45] Date of Patent: Apr. 14, 1987

[54] DUST SEPARATION APPARATUS

[75] Inventors: Bo Callgren, Strömbågen 3,, 803 45 Gävle; Eric Svensson, Gävle, both of Sweden

[73] Assignee: Bo Callgren, Gävle, Sweden

[21] Appl. No.: 746,243

[22] Filed: Jun. 18, 1985

[30] Foreign Application Priority Data

Jul. 4, 1984 [SE] Sweden ..... 8403563

[51] Int. Cl.[4] ..... B03C 3/10; B03C 3/14; B03C 3/74

[52] U.S. Cl. ..... 55/109; 55/113; 55/121; 55/127; 55/147; 55/148; 55/149; 55/151; 55/154

[58] Field of Search ..... 55/109, 113, 112, 114, 55/121, 127, 129, 141, 147–149, 151, 154

[56] References Cited

U.S. PATENT DOCUMENTS

| | | | |
|---|---|---|---|
| 949,041 | 2/1910 | Morscher | 55/114 |
| 1,444,092 | 2/1923 | Anderson et al. | 55/114 |
| 2,631,687 | 3/1953 | Dohrer | 55/121 X |
| 3,970,437 | 7/1976 | Van Diepenbroek et al. | 55/127 |

FOREIGN PATENT DOCUMENTS

| | | | |
|---|---|---|---|
| 336032 | 7/1972 | U.S.S.R. | 55/112 |
| 1024107 | 6/1983 | U.S.S.R. | 55/121 |

*Primary Examiner*—Kathleen J. Prunner
*Attorney, Agent, or Firm*—Silverman, Cass, Singer & Winburn, Ltd.

[57] ABSTRACT

A dust separation apparatus including a cyclone consisting of three sections, a first cylindrical section provided with a tangentially located inlet duct for dust-loaded waste gases, a second cylindrical section therebelow, and below that a third cone-shaped section. According to the invention, a rotor is located in the second section, which rotor carries outside its periphery one or more emission electrodes. A scraping device is provided outside the rotor to scrape accumulated dust from the inner surface of the second section, which surface acts as a precipitation electrode for dust particles charged by the emission electrode or electrodes.

8 Claims, 8 Drawing Figures

DUST SEPARATION APPARATUS

TECHNICAL FIELD

This invention relates to a dust separation apparatus, which is especially suitable for separating dust from gases from steel furnaces and other equipment used in heavy industry and from waste gases produced by the combination of solid and fossil fuels.

BACKGROUND OF THE INVENTION

For the aforesaid purposes, electrostatic dust separators generally are used, in which the dust particles are electrically charged and caused to deposit on precipitation electrodes.

One such known apparatus comprises a plurality of great plates, i.e. large metal sheets or plates made of a sheet metal material and having a square or rectangular shape, spaced from each other. Between the plates, frames are located in which a number of wires are clamped. A high-voltage rectifier, usually of 50 kW, is connected with its negative end to the wires, while its other end is grounded and connected to the plates. In this way, a strong electric field between the wires in the framework and the plate curtains (plates as described above which hang like curtains) is obtained. The field intensity is highest adjacent the wire surfaces where it becomes so high that electrical discharge in the form of corona discharge occurs along the wires. At the ionization of the gas effected about the wires, great amounts of positive and negative ions are formed continuously. The positive ions immediately are attracted to the negative wires. The negative ions, however, move from the respective wire to the nearest located plate curtain. The gas, from which the dust or particles are to be separated, is directed between the plate curtains.

On their path to the plate curtains, the ions to some extent colloid with and adhere on particles contained in the gas flow. The particles are therefore also negatively charged and start moving in the same direction as the ions, i.e. to the nearest located plate curtain. Upon contact with the plate curtains, the particles get deposited as a coat thereon and are discharged.

A certain dust coating takes place also on the wires, due to the fact that particles passing in the vicinity thereof can be met by positive ions found there and be attracted to the electrodes. The dust deposition caused in this way is quantitatively relatively small, but unfavourable for the corona discharge.

Increasing dust coat on the curtain plates and emission electrodes weakens the electric field and increases the ohmic resistance between the plates and electrodes. Both of these conditions reduce the dust separating capacity of the apparatus, and, therefore, the dust deposited must be removed step by step. This is carried out intermittently by causing the plates and frames to vibrate, so-called "pounding", by means of mechanical devices, at certain times. The agglomerated dust coat thereby gets loose and drops down into a dust collecting bin provided below.

The electrostatic filters presently in use and described above are bulky and expensive to install and operate. Moreover, they have other disadvantages which substantially reduce their dust separating capacity.

The aforesaid apparatuses, among others, are sensitive to variations in operation which give rise to more considerable variations in the dust concentration in the gas. For example, if for some reason the dust concentration happens to rise substantially, the dust coat on the plate curtains rapidly increases and increases also on the emission electrodes. As a result, the electric field is weakened and the electron emission is hampered. Therefore, a substantial portion of the charged dust particles do not have time to move all the way to a plate curtain, and instead follow along with the gas flow out of the apparatus. Consequently, they are not separated by the apparatus.

In the prior art, pounding of plate curtains and frames is started and stopped by timer and, thus, occurs without being related to the variations in the dust concentration in the gas, as should be required.

It is also quite common in prior art apparatuses for portions of the dust to get loose spontaneously when the dust deposition on the plate curtains increases in thickness. The apparatus is designed in such a way that all dust disengaging from the electrodes, either spontaneously or caused by said pounding, drops down in free fall to the dust collecting bin. During the fall, a great amount of the dust portions burst and are disseminated into a dust cloud which follows along with the flowing gas out of the apparatus, unless the fan means have been switched off. It is known by experience that the fan means, which in view of the aforesaid must have been switched off during the "pounding" in order to prevent great amounts of dust from being emitted into the ambient air, in many cases are switched off for too short a time or not at all.

When the electric field is increased in order to increase the dust retaining capacity of the plate curtains, glow discharge can occur in the dust layer. In that case, correspondingly to corona discharge along the emission electrodes, great amounts of both positive and negative ions are developed in the dust layer. The negative ions immediately drop in against the plate curtains. The positive ions, however, are drawn out into the space between the plate curtains and migrate to the wires. In the space between the wires and plate curtains both negative and positive ions will then be found and neutralize each other. This charge of the dust particles disappears entirely or partially, and the dust is moved out of the apparatus together with the gas flow.

By using a dust separation apparatus according to the present invention, inconveniences of the kind involved with the aforesaid apparatuses and their deteriorating dust separation capacity do not arise.

SUMMARY OF THE INVENTION

A dust separator according to the present invention differs radically from conventional apparatuses in respect to both design and mode of operation. The dust separator of the present invention yields a substantially more effective dust separation even at great variations in dust concentration in the waste gas. It also shows a far more stable retaining capacity for dust without the recurring disturbances in prior art apparatuses where a great part of the dust already separated intermittently leaves the filter together with the emitted gas when the plate curtains and electrode frames are subjected to pounding or when the dust coat between the plate curtains and the electrode frames gets loose spontaneously. The apparatus of the present invention further has the advantage that, as already mentioned, it requires only a fraction of the construction space required by an apparatus of conventional type.

The present invention thus relates to a dust separation apparatus with a cyclone consisting of three sections, a first cylindrical section provided with an inlet port located tangentially for dust-loaded waste gases, a second cylindrical section below the first section and below that a third cone-shaped section. The invention is characterized in that a rotor is located rotatably in the second section, which rotor has a diameter smaller than that of the second section and carries one or several emission electrodes located outside the rotor circumference. A scraper member is provided at the rotor and runs against the inner surface of the second section, which inner surfce is designed so as to be a precipitation electrode for dust particles charged by the emission electrode or electrodes.

BRIEF DESCRIPTION OF THE DRAWINGS

The invention is described in greater detail in the following description, with reference to an embodiment thereof illustrated in the accompanying drawings where.

DESCRIPTION OF THE PREFERRED EMBODIMENTS

Figure 1:
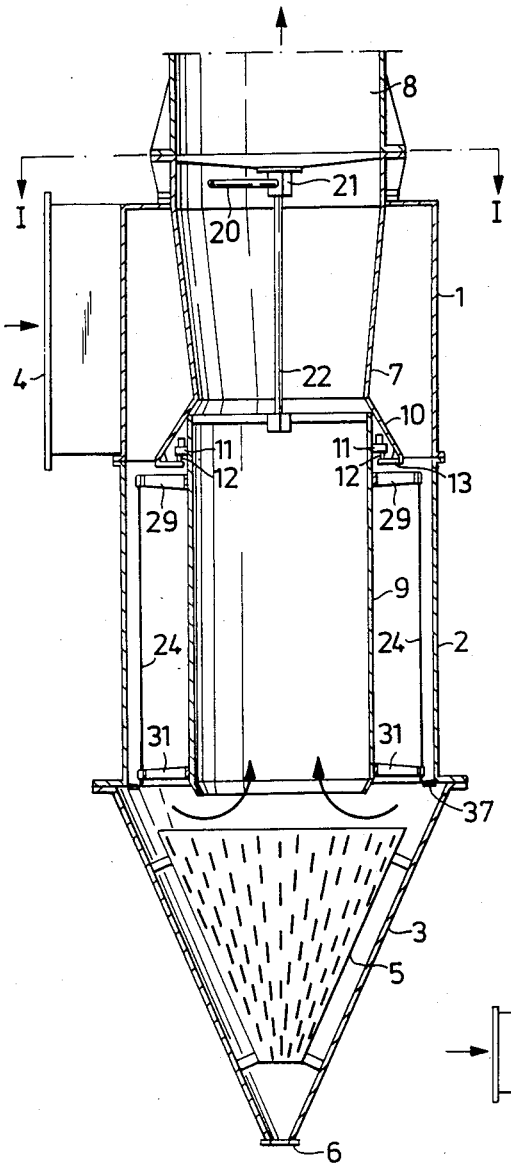
FIG. 1 is a vertical section through an apparatus according to the invention.

The dust separation apparatus according to the invention in principle is designed as a cyclone including three main sections which, in FIG. 1 are designated 1, 2 and 3. The section 1, which has a tangentially directed inlet duct 4, and the section 2 are assembled to form a cylinder, which in the embodiment of the apparatus here presented has a constant diameter along its entire height. The designation "cyclone" hereinafter in the description has been reserved for the upper portion 1, while the portion 2 is called the "precipitation casing" or "precipitation portion". The lowermost section 3 is the collecting funnel of the cyclone for separated dust. In this section, a perforated funnel 5 called a "particle screen", is mounted so that there is a free space between the screen and the surrounding collecting funnel 3. The lowermost section 3 is provided in its lowermost portion with a dust outlet 6.

Section 1 encloses an electrically insulated drum 7 with circular cross-section which at its top is connected to and has the same diameter as a chimney drum 8, through which the gas free of dust leaves the apparatus. The diameter of the drum 7 decreases toward its lower portion so that the diameter of drum 7 directly above the upper edge of a rotor 9 located in section 2 and projecting upward some distance into section 1 is about the same as the rotor diameter. The very lowermost portion of the drum 7 has the form of a projection 10 which encloses and protects the suspension and centering mechanism of the rotor 9, which is illustrated in detail in FIG. 2.

The rotor 9 consists of a vertical hollow cylinder wtih open end walls which can be electrically conductive or electrically insulated from all adjoining structural elements or in their entirety be made of electrically non-conducting material. The rotor is provided directly beneath its upper edge with an outer ring 11, see FIG. 4 and the detail view in FIG. 2, in which ring a circle of travelling wheels 12 are mounted. Wheels 12 roll on a horizontal annular course 13 attached to the lower edge of the projection 10 of the stationary drum 7.

On the lower surface of the course 13, a circle of horizontal centering wheels 14 are mounted which roll against the shell surface 9' of the rotor. The ring 11 for the travelling wheels 12 simultaneously constitutes a support and a hold for a contact rail 15 running about the rotor. The rail 15 receives negative electric potential from a voltage unit in the form of a high-voltage rectifier 16 via an insulated conductor 17 and a contact 18 of known kind.

Figure 3:
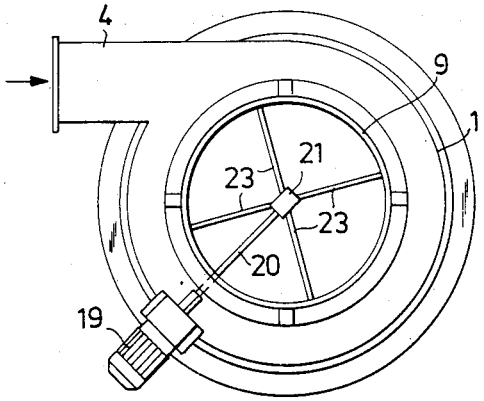
FIG. 3 is a sectional view along the line I—I in FIG. 1.

The rotor is caused to rotate by a motor 19, which drives an axle 20, a bevel gearing 21 and a vertical shaft 22, which in its turn drives a spoke system 23 mounted at the upper edge of the rotor, as shown in FIGS. 1 and 3.

Figure 4:
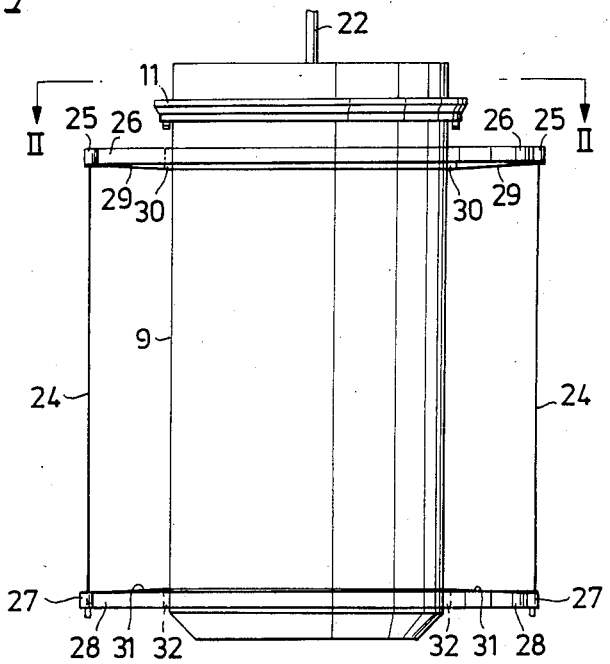
FIG. 4 is a lateral view of said rotor.
Figure 5:
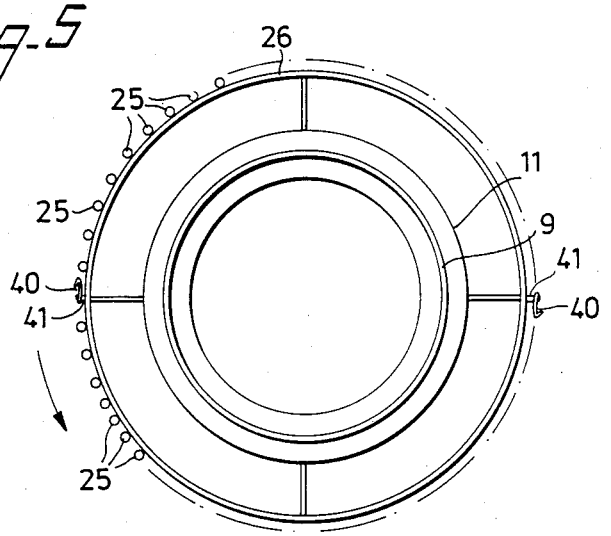
FIG. 5 is a horizontal sectional view along the line II—II in FIG. 4.

Referring to FIG. 4, the rotor 9 supports a system of one or more vertical emission electrodes 24, which may consist of metal wires, rods or metal net, and which are clamped between an upper 25 and lower 26 holding member provided for each electrode. The upper holders 25 are supported on an upper outer ring 26 and the lower holders 27 are supported on a lower outer ring 28. The upper ou er ring 26 is retained in position by a number of brackets or spokes 29, which extend from an inner ring 30 attached to the rotor casing 9 but are insulated electrically therefrom. The lower outer ring 28 is retained in place in a corresponding manner by means of spokes 31 extending from an inner ring 32.

Figure 6:
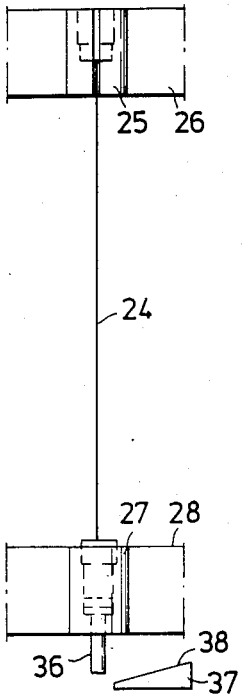
FIGS. 6 and 7 illustrate the top and bottom attachment of emission electrodes on the rotor.
Figure 7:
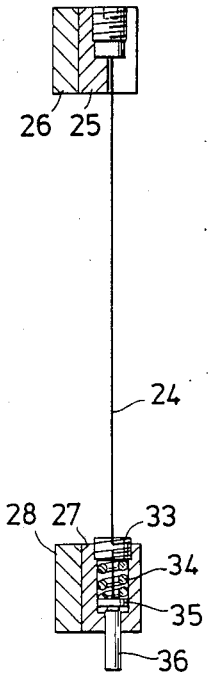

As shown in FIGS. 6 and 7, each electrode 24 is rigidly mounted at its upper end in its holder 25. In the holder 27, the lower end of the electrode 24 passes freely through a hole in a screw 33 through a helical spring 34 to a piston 35, to which the electrode is attached. The electrode 24 is maintained in a stretched condition by the expansion force of the spring 34 which can be adjusted by the screw 33.

Figure 2:
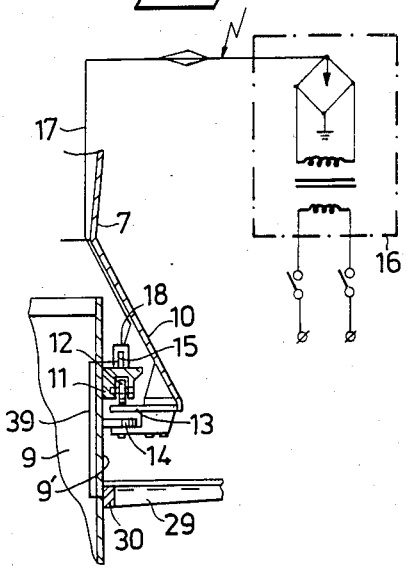
FIG. 2 shows in detail how the rotor is suspended and controlled.

The piston 35 is provided on the lower surface with a pin 36, which is freely movable in a hole in the bottom of the holder 27 and has a length such that it projects out below the same. On the same level as the projecting portion of the pin 36 a stationary shoulder 37 (FIG. 6) of electrically non-conductive material is located in one or several places about the inner surface of the precipitation portion 2 (FIG. 2). The shoulder has an inclined upper surface 38 and is mounted in relation to the rotation movement of the rotor such that upon rotation of the rotor the lower end of the pin 36 meets the inclined surface 38 and successively is pressed upward. The spring 34 is thereby pressed together by the piston 35, and the wire 24 is relieved. When during the continued movement the pin passes the closing edge of the shoulder 38, the spring 34 repels and the emission electrode is stretched again in a jerking fashion.

The system of wires 24 is maintained at a negative electric potential by the ring 30 which is connected to the contact rail 15 by a conductor 39, see FIG. 2, or by utilizing the rotor 9 as electric conductor.

Figure 8:
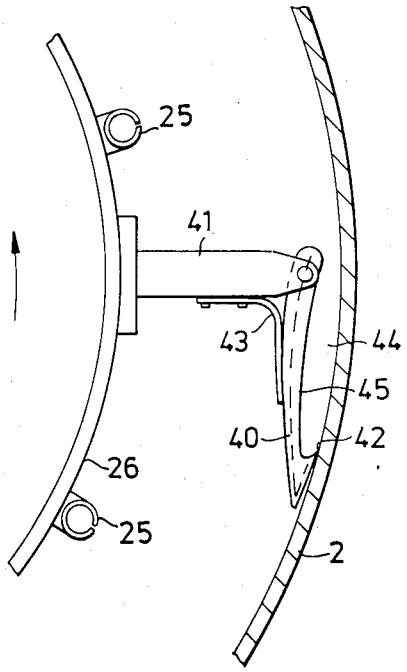
FIG. 8 is a horizontal sectional view of a scraper bar mounted on the rotor.

FIG. 8 is a horizontal section through a scraper device including a scraper strip which resiliently abuts the inner surface of the precipitation casing 2 as a generatrix follows along the same upon movement of the rotor.

The strip consists of a vertical bar 40 of metal cast in electrically insulating material. At its leading edge it is rotatably mounted at its upper and lower end in electrically non-conductive attachments 41, which are provided with a spring and have a vertical axis. The width of the metal bar is the same as that of the scraper strip, and its cross-sectional profile has a concave shape toward the precipitation casing 2. The scraper bar 40 is provided with a scraper member 42 of hook-like cross-section at the portion which, in the direction of movement, is its trailing portion.

The scraper device also has an oblong portion 45 which extends from the scraper member 42 forward in the direction of movement. An air pocket 44 is thereby formed between the scraper member and the inner surface of the precipitation casing 2. The scraper is pressed by the spring 43 of the attachment 41 to abut the casing 2. In the vertical plane the bar is suitably bent so as to ensure that the bar along the entire distance between the upper and lower suspension attachments 41 remains in good abutment to the casing. The outer section of the strip in the horizontal plane is formed so as to give rise to the least possible turbulence in the gas flow.

The mode of operation of the apparatus is as follows.

The dust-loaded gas flows into the upper portion 1 of the apparatus, the cyclone, through the duct 4 in a direction tangential to the axis of the cyclone, see FIGS. 1 and 3. The gas here meets the inner surface of the cyclone casing and is deflected in a circular path along the cyclone wall. In this manner, a radially outward centrifugal acceleration is caused at each air molecule and dust particle in the rotating gas mass due to the law of inertia, and each molecule and dust particle is affected by a centrifugal force of a size depending on the particle mass. Due to this effect, all particles during the rotation strive outward to the shell surface of the cyclone. Particles with the greatest mass density during the staying period in the cyclone 1 have sufficieint time to be concentrated in that part of the gas mass which rotates nearest to the shell surface. The lighter particles float in paths at different distances further from the inner shell surface.

The rotating gas mass with its dust content also has a vertical movement component. This is brought about by the fan means for the gas flow together with the acceleration due to gravity. The speed with regard both to the falling movement of the dust particles and their circulation movement is reduced nearest to the cyclone wall by friction forces against the same.

The drum 7, located centrally in the cyclone 1, has a diameter such that the cross-sectional area perpendicular to the flow direction of the gas mass rotating outside is smaller than the cross-section of the inlet duct 4. This implies that the gas speed increases in the cyclone, which in its turn causes both the centrifugal force on the dust particles, and therewith, the separation effect to increase.

The real procedure in the cyclone 1 has been described above only in a summary and simplifying manner, but yields a clear idea of how an essential positioning of the dust particles in the gas flowing in from the start is brought about. When the gas leaves section 1 and enters the precipitation portion 2, the main part of the dust particles has been concentrated adjacent the cyclone wall by so-called dynamic dust separation. As a first step of the dust removal, a positioning of the heaviest dust has been achieved.

The rotor 9 in section 2 of the apparatus can be said to have three functions. The first is to cause the particles in the concentrated dust accumulation adjacent the shell surface effected in section 1 to precipitate on the precipitation casing 2. The second function is to also cause the dust, which in finely distributed state still follows along with the rotating gas mass in paths inside of the dust mass accumulated at the periphery, to move outward to the shell and adhere thereon. The third function is to continuously scrape off dust precipitated on the shell and, without causing the dust to spread again, to convey the dust downward to the collecting funnel 3, which is a magazine for the dust and which intermittently or continuously is discharged through the outlet 6.

These functions are carried out as follows.

The negative pole of the high-voltage rectifier 16, as mentioned, is connected to the wires 24 through the conductor 17, contact device 18, contact rail 15 and conductor 39. The opposed pole and the outer casing of the dust separator are grounded. The system gives rise to an electric field where the casing 2 is the anode. The voltage of the wires is caused to be so high that corona discharge occurs along the wires 24. The wires therefore act as emission electrodes. Thus, a flow of negative ions goes out from here. When the dust particles are met by and bind ions to themselves, they are charged negatively and attracted with accelerating speed to the anode, i.e. to the casing 2, and adhere and are discharged thereon.

The distance between the wires 24 and the precipitation casing 2 is relatively short. The electric field and the electron concentration, therefore, are especially strong in this interspace, which is necessary in view of the many charges required by the high dust concentration and the resistance met by the electrons and charged dust particles on their path to the shell. On the other hand, the charging of the finely distributed dust particles in the greater space inside of the circle of wires 24 is promoted by the fact that the coarser dust fractions have been separated toward the periphery. Therefore, the remaining finely distributed particles are not concealed behind coarser dust particles and can more easily be met by emitted electrons and be charged sufficiently to deviate from their paths and move toward the precipitation casing.

The rotor is driven about the vertical axle 22 in turns opposed to the gas and dust flow, i.e. in a direction opposed to the direction of air into the cyclone through the tangential inlet duct 4. This is very essential because in this way the relative movement per unit time between the emission electrodes on one hand, and the gas/dust mixture on the other hand, is enlarged, i.e. each freely floating dust particle passes a greater number of electrodes during its circulation than it otherwise would pass. A corresponding enlargement in a conventional electric precipitator with a plane stationary electrode net would require the precipitator to be extended by a distance corresponding to the angular speed of the rotating electrode system, to the radius thereof and to the staying time of the gas in the precipitation part 2. Thus, the counter-current rotation of the emission electrodes increases the dust separation effect.

The third function of the rotor, continuous scraping off of dust precipitated on the casing 2 and undisturbed transport of the dust down to the collecting funnel 3, is effected by the vertical scraping strips 40 following along with the rotor movement. Due to the fact that the metal bar in the strips, cast-in in surrounding plastic, has a crosssectional area of concave shape to the outer casing surface 2, a vertically extending passageway with free flow is formed adjacent the casing wall. This flow is entirely screened off from the electric field between the emission electrodes and precipitation casing and from free ions. When the dust particles are scraped loose from the casing wall behind the screen, they still maintain their zero potential. The dust, therefore, without being charged and bound again, can flow down by free fall through the passageway and be discharged to the collecting funnel 3.

The cleaning of accumulated dust from the emission electrodes also takes place continuously. Each emission electrode or wire 24, as has become apparent, is prestressed by means of a screw and spring device in the lower holder 27. Every time the holder with its downward projecting pin 36 passes over a shoulder 37 with inclined upper surface 38 secured on the outer casing, the spring is compressed by the pin, but repels, as mentioned, when the shoulder has been passed. This procedure implies that the emission electrode first is relieved and thereafter stretched with a jerk, so that dust particles precipitated on the wire are shaken loose. The particles then are negatively charged and move over to the outer casing 2.

By means of this system, all electrodes, one after the other, are rapidly freed from dust continuously, one or more times, for each revolution of the rotor. It should have become apparent from the description that the present apparatus represents an entirely novel system for removing solid particles from dust-loaded gases on an industrial scale. The system has very essential advantages over the principles in the heretofore conventional electric precipitators.

In the new structural design, an effective positioning of the heavier particle fractions, i.e. the main part of the mass of dust content in the gas, is obtained by a cyclone with forced gas rotation. Thereby the most favourable prerequisites for the subsequent precipitation of the dust in an electrostatic way are provided. Lighter dust particles still contained in the interior of the rotating gas mass are not concealed by heavier, larger particles, because these are concentrated at the periphery. The lighter particles are therefore well exposed to the electron flow from the emission electrodes. The electric field and the electron concentration, on the other hand, are greatest in the outer space between the emission electrodes and precipitation casing, where the main part of the dust content in the gas already is accumulated and where also the finer dust gradually will arrive.

The emission electrodes further are mounted on a rotor, the rotation speed of which countercurrent in the gas mass can be adjusted so that the dust particles both outside and inside the electrode circle during their staying period in this part of the apparatus manage to be sufficiently affected to adhere to and remain on the precipitation casing, in spite of the small dimensions of the apparatus.

Also of greatest importance is the continuous scraping of the dust precipitate off from the precipitation casing and the corresponding continuous cleaning by shaking of the emission electrodes. The electric field strength and electron emission are constantly maintained, and dust accumulation on the precipitation casing which can give rise to glow discharge is prevented.

The design of the scraper strip in the form of an electrically screened groove through which dust scraped off is passed down to the collecting funnel, prevents the dust from entering the gas flow discharged from the apparatus. These means for a continuous removal of the dust contribute to render the dust separation apparatus relatively insensitive to substantial changes in the dust content of the gas which at times occur in operation.

The above description covers only one example of the apparatus design. Alternative ways of designing the structure in practice in several respects are available. For example, the degree of forcing of the rotation speed of the gas in the upper part of the apparatus, the cyclone part, can be changed by choosing the proportions of the flow area thereof. The wire-shape of the emission electrodes, furthermore, can be replaced by a cylinder of metal wire net comprising suitable means for continuously removing the dust coat, and the surface of the electrodes can be provided with tips. These and many other variants of the design of the apparatus are all within the scope of the invention idea.

The present invention, thus, must not be regarded as restricted to the embodiments set forth above, but can be varied within the scope of the attached claims.

We claim:

1. A dust separation apparatus of the type having a cyclone consisting of a first cylindrical section (1) provided with a tangentially located inlet duct (4) for dust-loaded waste gases, a second cylindrical section (2) therebelow, below that a third cone-shaped section (3) having a dust outlet (6) and a chimney drum (8) through which gas leaves the apparatus; comprising in combination:

a rotor (9) located rotatably in said second section (2) and having a diameter smaller than that of said second section;

means connected to said rotor for effecting rotation of said rotor;

at least one emission electrode (24) carried on the outside of said rotor;

a scraping device (40); and mounting means for mounting said scraping device on the outside of said rotor (9) such that said scraping device scrapes against the inner surface of said second section (2), which inner surface constitutes a precipitation electrode for dust particles charged by the emission electrode.

2. A dust separation apparatus as defined in claim 1, wherein said emission electrode (24) consists of a wire or rod supported by upper (25,26,29,30) and, respectively, lower (27,28,31,32) attachment means in the form of spokes extending from the rotor (9).

3. A dust separation apparatus as defined in claim 2, wherein said lower attachment means (27) comprises a projecting cylindric pin (36) on which said emission electrode (24) is attached and by action of a spring (34) said emission electrode is maintained stretched and said pin is in a projecting position, and a shoulder (37) is mounted about the inner surface of said second section (2) and has an inclined surface (38) positioned so that upon rotation of the rotor (9) the pin (36) successively is pressed from its projecting position into the attachment means (27), thereby relieving the emission electrode (24), and after the pin (36) has passed the inclined surface (38) the pin is moved to its projecting position by action of said spring (34), thereby stretching again the emission electrode (24) with a jerk.

4. A dust separation apparatus as defined in claim 1, further comprising a voltage unit (16) connected to and supplying a negative potential to a stationary contact device (18) abutting an electrically conductive rail (15)

secured to said rotor (9), and a conductor (39) in electrical contact with said conductive rail and said emission electrode supplies a negative potential to said electrode and said second section (2) is electrically grounded.

5. A dust separation apparatus as defined in claim 1, wherein said scraping device comprises a scraping strip (40), which at its trailing portion in its intended direction of movement is provided with a scraper member (42) of hook-like cross-section, and the scraping device comprises an oblong portion (45) extending from said scraper member (42) forward in said direction of movement, so that an air pocket is formed between the scraping device and said precipitation electrode (2).

6. A dust separation apparatus as defined in claim 1, wherein said means for rotating said rotor (9) rotates said rotor in a direction opposed to the direction of said tangential inlet duct.

7. A dust separation apparatus as defined in claim 1, wherein said first section (1) above said rotor (9) a cylindric drum (7) is located which has about the same diameter as the rotor (9).

8. A dust separation apparatus as defined in claim 1, wherein said rotor (9) consists of a hollow cylinder with open end walls, through which cylinder the gases flowing downward past its outside are intended to be discharged upward.

* * * * *